United States Patent [19]

Braun et al.

[11] Patent Number: 4,753,102

[45] Date of Patent: Jun. 28, 1988

[54] ARRANGEMENT FOR COUPLING AND DECOUPLING GRIPPER RAIL PARTIAL SECTIONS OF A TRANSFER PRESS

[75] Inventors: Hans Braun, Weilheim; Günter Cieslok, Goeppingen, both of Fed. Rep. of Germany

[73] Assignee: L. Schuler GmbH, Goeppingen, Fed. Rep. of Germany

[21] Appl. No.: 871,782

[22] Filed: Jun. 9, 1986

[30] Foreign Application Priority Data

Jun. 7, 1985 [DE] Fed. Rep. of Germany ..... 3520343

[51] Int. Cl.[4] ..... B21D 43/05

[52] U.S. Cl. ..... 72/405; 198/621; 285/382.4; 403/348

[58] Field of Search ..... 72/405, 421, 422, 404; 403/348, 349; 24/115 M, 136 R; 285/382.4, 382.5

[56] References Cited

U.S. PATENT DOCUMENTS

| | | | |
|---|---|---|---|
| 587,546 | 8/1897 | Dillenburg | 285/382.4 |
| 2,574,109 | 11/1951 | Kane et al. | 285/382.4 |
| 3,858,990 | 1/1975 | Busselmeier | 403/349 |
| 4,361,286 | 11/1982 | Hofmann et al. | 403/348 |
| 4,555,012 | 11/1985 | Baba et al. | 198/621 |
| 4,581,817 | 4/1986 | Kelly | 285/382.4 |
| 4,614,265 | 9/1986 | Glasberg | 72/405 |

FOREIGN PATENT DOCUMENTS

| | | | |
|---|---|---|---|
| 3300227 | 3/1985 | Fed. Rep. of Germany | 72/405 |
| 989997 | 4/1965 | United Kingdom | 285/382.4 |

*Primary Examiner*—Robert L. Spruill
*Assistant Examiner*—Donald R. Studebaker

[57] ABSTRACT

An arrangement for coupling and decoupling gripper rail partial sections of a transfer press in which the gripper rail partial sections are to be clamped together flange-like. The clamping bolt is adapted to be actuated by an adjusting drive in the displacement direction and in a rotary movement. A slide member displaceable in the end portion of the gripper rail partial section includes slide guidances which extend at an inclination to the displacement direction and in which pressure members are displaceably supported. During the displacement of the clamping bolt, the slide member is moved along and the pressure members are displaced into the separating gap between the gripper rail partial sections under abutment at stop members in the end portion of the gripper rail partial section to be coupled. The clamping anchor is adapted to be fixed at a ball socket by rotation and by retraction.

8 Claims, 2 Drawing Sheets

ARRANGEMENT FOR COUPLING AND DECOUPLING GRIPPER RAIL PARTIAL SECTIONS OF A TRANSFER PRESS

The present invention relates to an arrangement for coupling and decoupling gripper rail partial sections of a transfer press, with clamping elements displaceable from one gripper rail partial section portion into the other gripper rail partial section portion for purposes of bridging the separating gap between the end portions of the gripper rail partial sections and with pressure members movable by the clamping elements transversely to the displacement direction thereof as well as with a clamping means for the movement of the clamping elements in and opposite the displacement direction.

For shortening the refitting time of transfer presses the gripper rail partial sections carrying gripping devices are adjusted to the transport of the subsequent workpiece to be manufactured and are interchanged with the work tool change. These interchangeable gripper rail partial sections are to be coupled into a rigid structure with the gripper rail partial sections on the side of the press which remain in the transfer press. The coupling and decoupling takes place automatically. A separating gap thereby remains between the gripper rail partial sections to be coupled with one another. The components effecting the coupling and decoupling condition are disposed in the gripper rail partial sections on the side of the press.

An arrangement of the aforementioned type is disclosed in the DE-A-No. 33 00 227. This arrangement includes hollow profile members secured at the end faces of the mutually facing ends of the gripper rail partial sections. An expanding mandrel is arranged in one hollow profile member which is axially displaceable into the other hollow profile member. The expanding mandrel includes a spindle adapted to be set into rotation outside of the gripper rail partial section which spindle cooperates with an axially adjustable sleeve. The sleeve carries expanding mandrel members whose distance to one another is reduced upon abutment of the sleeve at a stop fixed at the spindle. As a consequence of this adjusting movement of the sleeve prism-like shaped pressure members are moved into such a position that they cover correspondingly shaped grooves in the end areas of the two gripper rail partial sections facing one another at a distance. With the reduction of the distances or spacings of the expanding mandrel members, the pressure members are displaced outwardly for engagement with the grooves and are pressed into the same. A disadvantage of this prior art construction resides in the high manufacturing accuracies under which the coupling parts have to be manufactured in order to effect a completely satisfactory coupling. A further and significant disadvantage of this prior art arrangement resides in that the necessary coupling forces have to be produced by radial forces and the connection is therefore less rigid in bending.

In contrast thereto it is the object of the present invention to connect the ends of the gripper rail partial sections which are to be coupled at one another, flange-like with one another. The abutment pressure is thereby to be produced by a draw or tensional force which compensates for the manufacturing inaccuracies.

The underlying problems are solved according to the present invention by a slide member taken along by the movement of the clamping means in and opposite the displacement direction and by pressure members supported in the slide member which upon abutment at stop members in their gripper rail partial section to be coupled are displaced outwardly into the separating gap during the further movement of the slide member in the displacement direction and which during movement of the slide member in a direction opposite the displacement direction are retracted out of the separating gap and are guided back together with the slide member.

Advantages of the present invention reside in and result from the fact that the separating gap or joint is closed off by the pressure members and the force-flow passes through the outer walls of each gripper rail partial section and through an inherently rigid clamping element. The closure of the separating gap is attained before the ends of the gripper rail partial sections are pressed against one another.

These and other objects, features and advantages of the present invention will become more apparent from the following description when taken in connection with the accompanying drawing, which shows, for purposes of illustration only, one embodiment in accordance with the present invention, and wherein.

Figure 3:
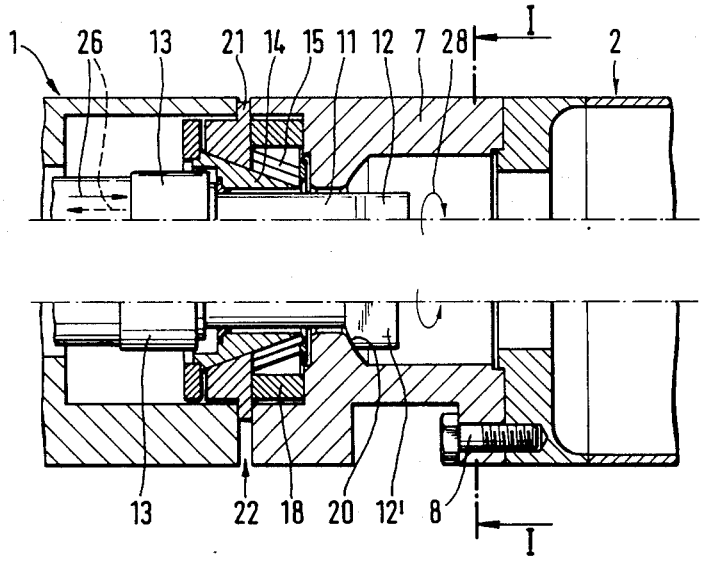
Figure 4:
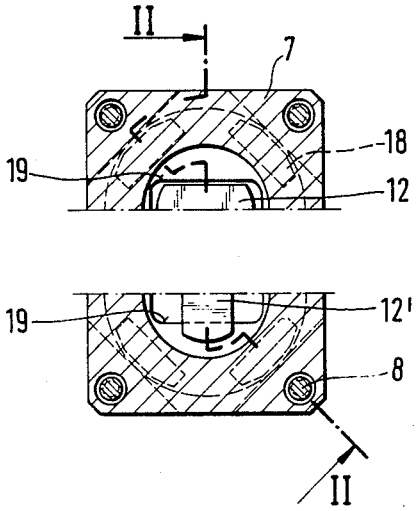

FIG. 3 is a partial cross-sectional view of the ends of the gripper rail partial sections to be coupled to one another in accordance with the present invention taken along line II—II of FIG. 4, whereby the upper half of the drawing illustrates the instant of the closure of the separating gap and the lower half the completed coupling condition; and FIG. 4 is a cross-sectional view taken along line I—I of FIG. 3.

Figure 1:
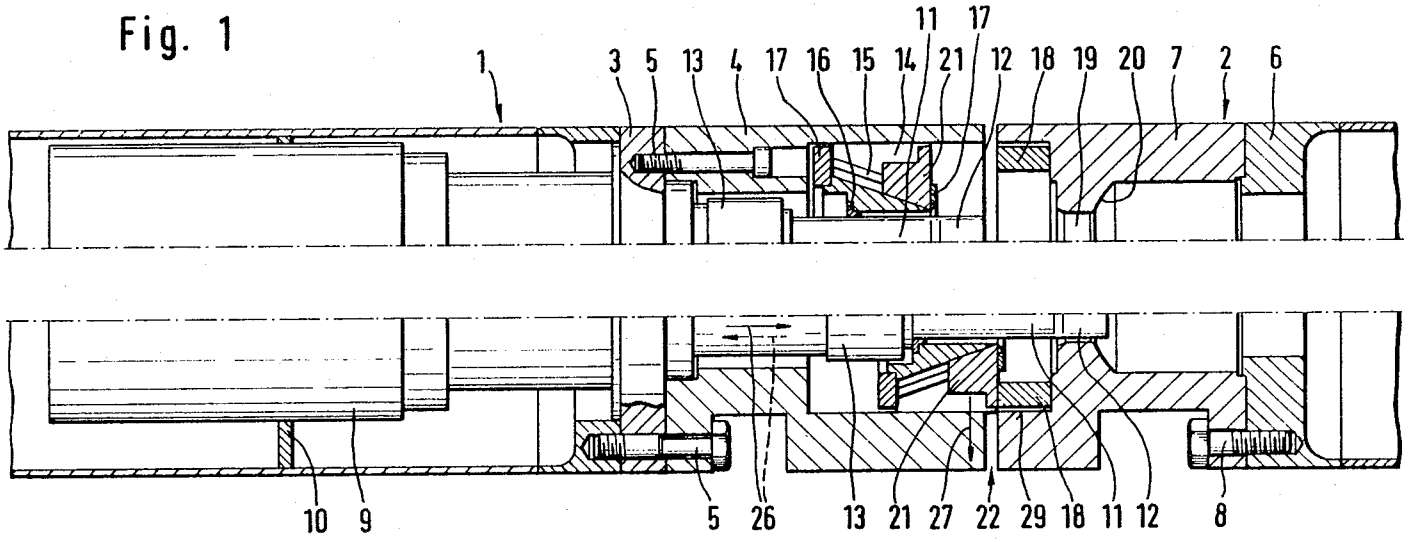
FIG. 1 is a cross-sectional view of the end area of gripper rail partial sections to be coupled to one another, taken along line II—II of FIG. 4, whereby the upper half of the drawing illustrates the decoupled condition and the lower half of the drawing the beginning of the coupling operation.

Referring now to the drawing wherein like reference numerals are used throughout the various views to designate like parts, and more particularly to FIGS. 1 and 3, gripper rail partial sections generally designated by reference numeral 1 and 2 are illustrated in these figures which are in a coupling position. The coupling position is achieved in that the interchangeable gripper rail partial section 2 which is adapted to be moved, for example, together with the sliding table of the transfer press, is moved by way of hydraulic means into a position aligned with the gripper rail partial section 1 which remains in the transfer press. The gripper rail partial section 1 includes in its end area a baseplate 3 and a a housing 4 which are detachably secured by way of bolts or screws 5. A clamping means 9 is flangedly connected to the baseplate 3. The clamping means 9 is supported in a bearing plate 10. The clamping means 9 is controllable hydraulically, pneumatically or also electrically in such a manner that a clamping bolt 11 can be displaced into a displacement direction 26, upper arrow, and into a displacement direction opposite thereto, lower arrow, and into a rotary movement 28 (FIG. 3). Such a clamping means 9 is a commercially available rotary clamping unit with forward and backward displacement means. The clamping bolt 11 is provided with an extension 13 in the area near the clamping means 9 and with a clamping anchor 12 within the end area remote from the clamping means 9. The extension 13 is adapted to be placed against a pressure member 14, illustrated more fully in FIG. 2, during the displacement of the clamping bolt 11 under interposition of a thrust washer 16. After displacement in the displacement direction 26—upper arrow—the clamping anchor 12 is operable to be subjected to a rotation 28 through 90° and to a retraction opposite the displacement direction 26—lower arrow—and is thereby adapted to be placed against a ball socket 20 in a housing 7 secured by way of threaded means 8 and an end plate 6 in the end area of the interchangeable gripper rail partial section 2. The position of the clamping anchor 12 rotated through 90° is designated by reference numeral 12' in FIG. 4. The housing 7 includes an elongated aperture 19 in the form of the cross-section of the clamping anchor 12 for the passage therethrough of the latter. Stop members 18 are screwed into an enlargement 29 (FIG. 1) in the end face of the housing 7.

Figure 2:
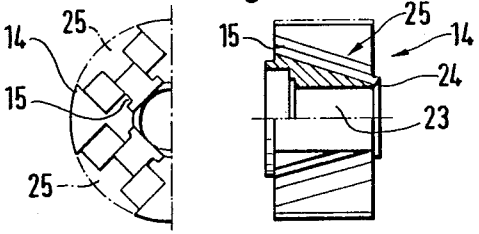
FIG. 2 illustrates a slide member in accordance with the present invention, for receiving pressure members and for the deflection of the movement of the pressure members from the displacement direction into a movement transversely thereto, whereby in the left part illustrates half a side elevational view and the right part half a cross-sectional view of the operating position of the slide member.

The slide member 14 includes according to FIG. 2 circumferentially a number of guide grooves, in the illustrated embodiment four guide grooves 25 with slide guidances 15, a bore 23 for the passage of the part of the clamping bolt 11 carrying the clamping anchor 12 as well as a ball socket 24 for the abutment of the clamping anchor 12 during the retraction of the clamping bolt 11 corresponding to the lower arrow 26.

One pressure member 21 each is adapted to be inserted into the guide grooves 25 which have complementary shapes corresponding to the guide areas. The pressure members 21 are secured in the slide member 14 by closure plates 17.

If the clamping bolt 11 is moved from its retracted position, FIG. 1, upper drawing half, in the displacement direction 26, upper arrow, then the extension 13 comes into abutment at the slide member 14 under interposition of the thrust washer 16 and moves the slide member 14 and the pressure members 21 supported within the same. The pressure members 21 thereby comes into abutment at the stop members 18, FIG. 1, lower drawing half. If the clamping bolt 11 and together with the same the slide member 14 is continued to be moved, then the pressure members 21 are displaced outwardly with respect to the displacement direction 26 in the adjusting direction 27 as a consequence of the inclination of the slide guidances 15 so that the shorter leg of the pressure members 21 which are essentially L-shaped in their longitudinal cross-section, penetrates into the separating gap 22 and fills the same at least in part, FIG. 3, upper drawing half.

The clamping together of the gripper rail partial sections 1 and 2 at one another takes place by rotation, arrow 28, and by retraction of the clamping bolt 11 in its displacement direction 26, lower arrow, under abutment of the clamping anchor 12 at the ball socket 20, FIG. 3, lower drawing half.

The disengagement of the coupling condition takes place essentially in the reverse sequence. For that purpose the clamping anchor 12 abuts against the ball socket 24 on the slide member 14. As a result of the movement of the slide member 14 in the displacement direction 26, lower arrow, the pressure members 21 are at first retracted inwardly under abutment at the end face of the housing 4 in order to be moved along together with the slide member 14 into the position illustrated in FIG. 1 in the upper drawing half, after the release from the end face.

FIG. 4 illustrates the aperture 19 in the housing 7 for the passage of the clamping anchor 12, the clamping anchor 12 rotated into the rotary position 12' as well as the stop members 18 shown in dash lines. These stop members 18 are kept smaller in their cross-section than the cross-section of the guide groove 25 in the slide member 14 in order to thus enable a further movement of the slide member 14 after the abutment of the pressure members 21 at the stop members 18.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. An arrangement for coupling and decoupling gripper rail partial sections of a transfer press at end portions of the gripper rail sections, comprising displacing means for displacing clamping elements in a displacement direction from one gripper rail partial section into the other gripper rail partial sections for bridging the separating gap between the end portions of the gripper rail partial sections, and clamping means for the movement of the clamping elements in and opposite the displacement direction, said clamping elements including slide means taken along with the movement of the clamping means in and opposite the displacement direction, and pressure means supported in the slide means which during abutment at stop means in the gripper rail partial section to be coupled are displaced outwardly into the separating gap during the further movement of the slide means in the displacement direction and which during the movement of the slide means in a direction opposite the displacement direction are retracted out of the separating joint and are guided back together with the slide means and wherein said clamping means couples the end portions of the gripper rail sections at the separating gap through the outwardly displaced pressure means.

2. An arrangement according to claim 1, wherein said clamping means is secured in one gripper rail partial section and includes a clamping bolt operable to be actuated in and opposite the displacmeent direction and in a rotary movement about its longitudinal axis, said clamping bolt having a clamping anchor for detent engagement behind a clamping surface in the gripper rail partial section to be coupled.

3. An arrangement according to claim 2, wherein said clamping bolt includes an extension, said slide means being displaceable out of the relatively fixed gripper rail partial section and into the other gripper rail partial section to be coupled, said clamping bolt being operable to be placed against said other gripper rail partial section with both its extension and its clamping anchor, the slide means including slide guidances for receiving a pressure means each, the slide guidances being inclined to the displacement direction and extending rising toward the extension of the clamping bolt, and the stop means being provided in the other gripper rail partial section to be coupled for abutment of the pressure means during the movement of the slide means in the displacement direction.

4. An arrangement according to claim 3, wherein the slide means are provided with guide grooves disposed pairwise mutually opposite in the slide means and forming the slide guidances, and the stop means being secured in the end face of the other gripper rail partial section facing the guide grooves.

5. An arrangement according to claim 4, wherein each pressure means is essentially L-shaped in longitudinal cross-section and the inclination of the slide guidance provided in the longer legs corresponds to the inclination of the slide guidances in relation to the displacement direction.

6. An arrangement according to claim 5, wherein each end area of the relatively fixed gripper rail partial section receiving a clamping means is constructed multi-partite and includes at least a housing means for receiving the displaceable clamping elements and a baseplate for securing the clamping means, and wherein the housing means and baseplate are detachably secured at the relatively fixed gripper rail partial section.

7. An arrangement according to claim 3, wherein each pressure means is essentially L-shaped in longitudinal cross-section and the inclination of the slide guidance provided in the longer legs corresponds to the inclination of the slide guidances in relation to the displacement direction.

8. An arrangement according to claim 1, wherein each end area of the relatively fixed gripper rail partial section receiving a clamping means is constructed multi-partite and includes at least a housing means for receiving the displaceable clamping elements and a baseplate for securing the clamping means, and wherein the housing means and baseplate are detachably secured at the relatively fixed gripper rail partial section.

* * * * *